United States Patent [19]

Nagel

[11] 4,171,788

[45] Oct. 23, 1979

[54] POWER TRANSFER APPARATUS FOR RAILROAD TRACK CIRCUITS

[75] Inventor: Harry C. Nagel, Murrysville, Pa.

[73] Assignee: Westinghouse Air Brake Company, Swissvale, Pa.

[21] Appl. No.: 903,428

[22] Filed: May 8, 1978

[51] Int. Cl.[2] ..... B61L 21/06

[52] U.S. Cl. ..... 246/40; 246/34 R

[58] Field of Search ..... 246/34 R, 40, 41, 125, 246/128, 130

[56] References Cited

U.S. PATENT DOCUMENTS

| | | | |
|---|---|---|---|
| 1,914,958 | 6/1933 | O'Hagan | 246/40 |
| 2,290,446 | 7/1942 | Pflasterer | 246/34 R |
| 2,880,307 | 3/1959 | Martin | 246/34 R |

*Primary Examiner*—Reinhard J. Eisenzopf

*Attorney, Agent, or Firm*—A. G. Williamson, Jr.; R. W. McIntire, Jr.

[57] ABSTRACT

At the remote end of a Type C track circuit, the conventional diode and the winding of a power transfer relay connected in multiple are connected across the rails over a transfer relay front contact. This transfer relay and the track relay at the near end are normally energized by the same half cycle of track current from the alternating current (AC) source. If the AC source fails, a track battery is connected across the rails at the remote end in series with the diode and transfer relay multiple network over a transfer relay back contact. The diode is so poled that the track relay is energized from the track battery with the same polarity as the rectified alternating current and does not release during the transfer operation. The diode bypasses substantially all track battery current away from the transfer relay. When the AC source is restored, the transfer relay is initially energized by the rectified alternating current through a low impedance capacitor, connected in multiple width the track battery and transfer relay back contact, and picks up to restore normal track circuit operation.

6 Claims, 1 Drawing Figure

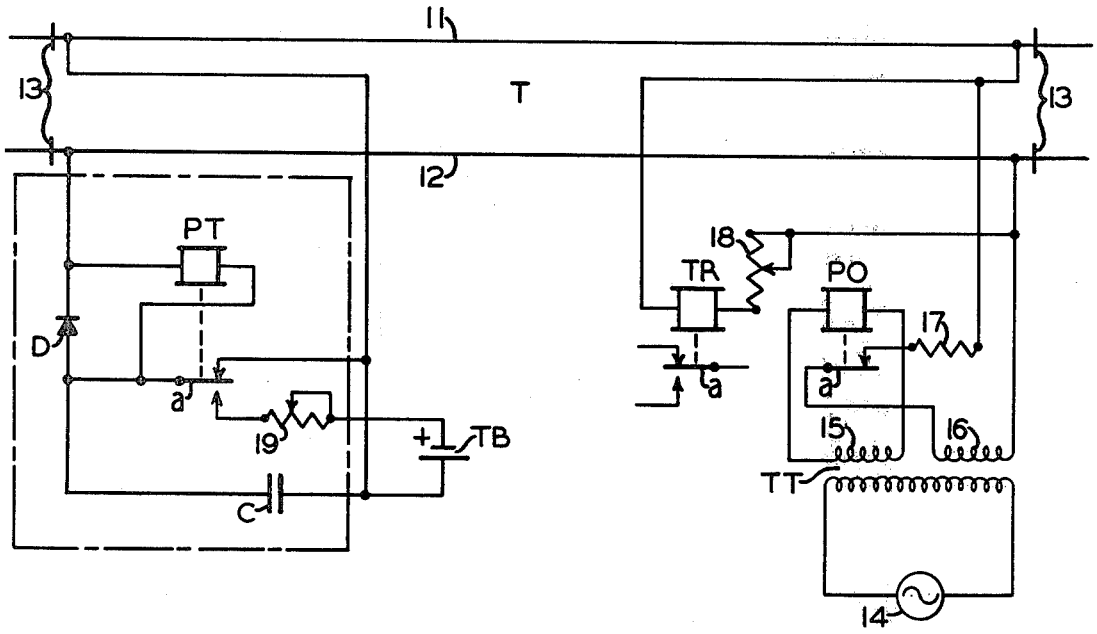
11
13
T
13
12
PT
D
a
19
+
TB
C
18
TR
a
PO
17
a
15
16
TT
14

POWER TRANSFER APPARATUS FOR RAILROAD TRACK CIRCUITS

BACKGROUND OF THE INVENTION

My invention pertains to power transfer apparatus for railroad track circuits. More specifically, the invention relates to apparatus which substitutes a track battery power supply to maintain track circuit operation when the normal alternating current power source fails.

Continuous operation of the track circuits in spite of power outages is a desirable condition in railway signaling. One specific situation relates to such track circuits used to control highway crossing warning signals where the failure of the track circuit from any cause, including power outage, activates the signals which warn and stop highway traffic. Such improper warning conditions are undesirable since they create a public attitude of ignoring the warning indication when valid. Track circuits energized with commercial alternating current are peculiarly sensitive to power outages. This is particularly true of the so-called Type C track circuits illustrated in the U.S. Pat. to O'Hagan, No. 1,914,958. These track circuits have an alternating current energy source and the track relay connected to the rails at the same end, usually at the highway crossing, and a rectifier means, normally a single diode for half-wave rectification, connected across the rails at the remote end of the circuit. Such track circuits are particularly useful in highway crossing warning systems where the track is otherwise unsignaled and wayside line circuits to the remote ends for power or indications are not available. A past practice has been to connect a standby track battery across the remote end of the track section in series or in parallel with the diode rectifier. More sophisticated arrangements connect the track battery to the rails only when an alternating current power outage is detected. This last arrangement requires a detection at the remote end of the presence and/or the absence of the alternating current energy in the rails. Connecting the track battery to the rails for permanent standby reduces the track circuit sensitivity and requires good ballast conditions and a large capacity AC source, that is, transformers with greater capacity. Similar conditions must be overcome when a changeover arrangement is used which substitutes the track battery at the remote end only when needed. It is also advisable and desirable to avoid any release of the track relay during a changeover period since this would cause at least momentary warning signals. Therefore, the requirements are for a Type C track circuit power transfer arrangement which allows the use of a lower energy AC source (smaller capacity transformers) with power regulation and which remains operable under poor ballast resistance conditions. Also no drop away of the track relay, i.e., false detection, should occur during the changeover to standby or in the reverse direction when AC power is restored.

OBJECTS AND SUMMARY OF THE INVENTION

Accordingly, an object of my invention is an improved power transfer apparatus for railroad track circuits to provide continuity of operation.

Another object of the invention is a power transfer arrangement for a railroad track circuit which eliminates the drop away of the track relays during the transfer operations.

A further object of my invention is a standby power transfer circuit arrangement for a Type C railroad track circuit which will allow operation on a lower voltage, poorly regulated alternating current source using a single diode at the remote end of the track section.

Still another object of the invention is an arrangement, for substituting a standby battery to energize a normal Type C track circuit when the alternating current source fails, which does not load the track circuit when restoring to normal AC operations so that a lower alternating current voltages and poor ballast conditions may be tolerated.

The invention lies in substituting a standby power source for a Type C track circuit to assure continuity of operation if the alternating current power source fails. The arrangement at the remote end of the track section, i.e., the end other than where the track relay is located, connects a direct current power transfer relay in multiple with the usual diode. This network is connected across the rails over a front contact of the transfer relay. The diode is so poled that the transfer relay is energized by the same half cycle of the alternating current as is the track relay at the source end. If the alternating current energy fails, the transfer relay releases to connect a standby source across the rails in series with the multiple network over a back contact of the transfer relay. In the specific showing, the standby source is a track battery poled to supply track current through the diode and thus bypass the transfer relay which does not pick up in response to the standby energy. When the alternating current energy is restored, a circuit path for the half cycle blocked by the diode is through the transfer relay winding and a low impedance capacitor connected to bypass the standby source and the back contact so that the transfer relay is reenergized and picks up to restore the normal track circuit arrangement. Because of the capacitor, the battery does not load down the transfer relay and lower the alternating current voltage level below pickup requirements so that the relay will restore normal operation. Since the single diode used is not in series with the transfer relay winding, a lower quality diode, that is, one with a higher forward resistance and thus more economical, can be used and a lower level of alternating current source voltage is satisfactory also.

Other objects, features, and advantages of the invention will become apparent from the following description and appended claims.

A SPECIFIC DESCRIPTION OF THE ILLUSTRATED EMBODIMENT

The single drawing FIGURE illustrates a Type C railroad track circuit including a power transfer arrangement embodying the invention.

Referring to the drawing, the single lines designated 11 and 12 represent the rails of a stretch of railroad track which is set off into a section T by the insulated joints 13. This section is provided with a track circuit of the well known Type C form, a basic arrangement of which is shown in the previously cited O'Hagan patent. At the right-hand end of the section, also called the source or near end, an alternating current (AC) energy source 14, shown by a conventional symbol and which may be the commercial power source of the usual frequency, is connected across the primary winding of the track transformer TT which has two secondary windings 15 and 16. Connected across winding 15 is a power of detection means shown conventionally as a power of relay PO. Such relays or arrangements are well known in the art and as long as source 14 is active, relay PO is energized to close its front contact a. The closed front contact a of relay PO completes the connections from secondary winding 16 to rails 11 and 12, including a limiting resistor 17, to supply AC energy from energy from source 14 to the rails of the track circuit.

Also connected across rails 11 and 12 at the near end of the section, in series with a variable resistance 18, is a track relay TR. Relay TR is a direct, neutral type, vital relay which will not respond to alternating current of any frequency. Thus, relay TR is not directly energized by energy from source 14. The track relay detects the presence or absence of a train in section T by its released or picked up condition, respectively. In other words, when front contact a of relay TR is closed, it registers a section clear or unoccupied by a train. Conversely, when front contact a is open and back contact a is closed, the occupany of section T by a train or some other unsafe condition is registered.

Briefly reviewing the basic operation of the Type C track circuit, it is assumed that diode D shown at the left is connected directly across the rails at the other or remote end of section T with its forward resistance direction from rail 11 to rail 12. During the half cycle of the alternating current output of winding 16 that the left terminal of this winding is positive, current flows through rail 11, diode D, and returns through rail 12 to the other terminal of winding 16. Resistance conditions in the rail and diode are such that substantially all of the current during this half cycle flows through the track rails and diode and very little through the winding of relay TR. During the half cycle when the output of winding 16 is of the opposite polarity so that rail 12 becomes positive, the diode blocks the flow of current through the rails and the half cycle of energy flows through the winding of relay TR and resistance 18. Relay TR is thus energized by substantially single direction current in the form of alternate half cycles of the alternating current, which is sufficient to pick up and hold this relay energized so that its front contact a remains closed. When a train shunts the track section, that is, across rails 11 and 12, both half cycles of the alternating current flow through the shunt and relay TR is thus deenergized and releases to register the train occupancy. This type of track circuit is thus very useful where it is inconvenient and/or quite expensive to supply operating energy for the track circuit at the remote end, or conversely, to detect trains at the remote end and transmit the resulting indications to the near end for use. Typically, this situation exists where a highway crossing warning system is to be installed on what is otherwise unsignaled railroad track and commercial power is available only immediately adjacent to the highway.

It is obvious that, without other measures, a track circuit of this type ceases operation if source 14 fails or the alternating current supply to the rails is otherwise interrupted. This will cause the circuit to improperly register an occupied track section and, for example, a highway crossing signal to improperly display a warning indication which highway users would find at least inconvenient. This situation may be overcome by providing an independent standby source at the remote end of the section, for example, a track battery such as TB shown to the left of the drawing. This may be a primary cell battery of preselected life or capacity which is replaced or renewed by a periodic maintenance program. The manner of substituting or transferring the track battery TB into service is a matter of choice and various prior art methods are known. However, the invention herein lies in an improved and more efficient method of transferring between the normal and standby sources of energy for this type of a track circuit.

The heart of my invention is within the dot-dash block shown to the left of the drawing at the remote end of section T. In fact, the apparatus may be packaged within what then is called a transfer unit which would include diode D, a power transfer relay PT, a capacitor C, and a variable resistor 19. Track battery TB is connected external to this box for easy replacement and maintenance. Relay PT is a direct current type relay but need not have vital characteristics since any unusual operation or failure will not result in an unsafe condition in the track circuit. The winding of relay PT and diode D are connected in multiple and this multiple or parallel network is normally connected across rails 11 and 12 over front contact a of relay PT. Diode D is poled with its forward resistance direction from rail 11 to rail 12 so that, with source 14 active to supply energy to the rails, it passes the half cycle of alternating track current when rail 11 is positive with respect to 12 and blocks the alternate half cycle when a reverse polarity condition exists. Diode D is not limited as to type but may be of the silicon type diode, which is more economical to purchase, since the forward resistance level is not critical in this apparatus. Since diode D blocks alternate half cycles of the track current, these half cycles flow through the winding of relay PT to hold this relay energized and picked up in the same manner as track relay TR is energized. It will be noted that it is the same half cycle of the alternating current track energy which energizes the two direct current relays.

Track battery TB is connected in series with resistance 19 and together in series with the multiple path network diode D, relay PT over back contact a of relay PT. When this back contact a is closed, battery TB is so poled that the direct current flows through diode D which shunts substantially all this battery current away from the winding of relay PT. For example, the forward resistance of diode D may be approximately 20% of the resistance of the winding of relay PT so that this relay receives insufficient energy to pick up under these conditions. The final element within the transfer case is capacitor C which is of a low impedance and is connected in multiple with front contact a of relay PT or under other conditions in multiple with back contact a, resistance 19, and battery TB in series. With low impedance, this capacitor will pass both AC half cycles around battery TB during the reset action, which will be subsequently explained.

I shall now describe briefly the operation of the track circuit operation including the power transfer apparatus. First, assuming normal conditions, I shall define a positive half cycle of the alternating current as that when the right terminal of winding 16 is positive and conversely a negative half cycle as that when the left terminal of winding 16 is positive. During a positive half cycle, with rail 12 positive with respect to the other rail, diode D blocks the flow of current and the half cycle current flows through the windings of relays TR and PT, the circuit at the remote end including front contact a of relay PT. During the negative half cycle of the energy, when rail 11 is positive, diode D passes the current in the forward direction through front contact a of relay PT and shunts the energy away from the windings of both relays. All flow of current through the relay windings is thus in the same direction, that is, half-wave rectified, and these relays are sufficiently energized to pick up and to hold under this condition, so that their front contacts will remain closed. When a train occupies the section, as previously explained, it bypasses or shunts all current from the remote end of the section so that relay PT is deenergized and releases and substantially all alternating current flows through the wheel and axle shunt of the train away from relay TR which likewise releases to register train occupancy. In addition, since diode D is beyond the shunt, no rectification of the track current occurs so that relay TR is also nonresponsive to any current which may flow through its winding. Exept for the inclusion of the winding and contact of relay PT at the remote end, this is the basic operation of the Type C track circuit as previously described.

If source 14 fails or its connections to transformer TT are interrupted, no energy is supplied from winding 16 to the rails. Relay PO is also is deenergized and releases to interrupt the track circuit connections at its front contact a. This disconnects winding 16 from the rails to remove this additional load from the track battery, as will be apparent. At the remote end of section T, relay PT is deenergized, with no energy in the rails, and releases to close its back contact a to connect battery TB to the rails through resistance 19 and diode D. It is to be noted that the positive battery terminal is connected to rail 12 through diode D in its forward direction so that the same polarity exists on the rails as that of the half cycle which normally energizes relays PT and TR. At the near or source end, track current from the battery is applied to relay TR, flowing from rail 12 through resistance 18 and relay winding to rail 11. This is no change from the normal energization of this relay except that it is now continuous. Relay TR has sufficient residual magnetism, since the flow of its energizing current is not reversed under these conditions, to hold the relay contacts picked up while contact a of relay PT at the remote end shifts from its front to its back position to reenergize the track rails. Further, relay PT releases very rapidly so that the interval of deenergization is minimal. Track circuit operation thus continues without interruption. This is important since no brief or momentary release of relay TR occurs to register an occupied track condition and any apparatus responsive to such release is not activated. Also as previously discussed, relay PT is not sufficiently energized by the current from the battery TB, since substantially all of such current flows through diode D, and relay PT remains released while the standby source is in service.

When source 14 is restored to service, windings 15 and 16 are agains energized. Relay PO picks up to close its front contact a and thus complete the rail connections from winding 16. When the first defined positive half cycle of the alternating current occurs so that rail 12 is positive, energy is blocked by diode D at the remote end and also by the track battery TB. However, a circuit path does exist from rail 12 to rail 11 through the winding of relay PT and capacitor C, which is of low impedance, so that current flows and relay PT is energized. This relay picks up to shift its contact a to its front position which disconnects battery TB, shunts capacitor C, and restores the normal track circuit arrangement at the remote end. It is to be noted that during this energization action, diode D is not in the pick up circuit so that it does not load the winding of relay PT and/or the alternating current source, that is, winding 16. The same positive half cycle of energy from source 14 also drives current through the winding of relay TR so that this relay holds as the track battery is disconnected. Thus, Type C track circuit operation is restored without any release of relay TR. Actually a similar type of reset action occurs when a train clears track section T except that relay TR, having released to register the track occupancy, must also pick up on the first positive half cycle of the alternating current.

The track circuit arrangement of the invention thus provides a simple means for transferring from Type C track circuit operation to a standby energy source in event of failure of the normal AC energy source. This transfer is accomplished without any momentary release of the track relay to actuate a signal indication indicating the presence of a train. The arrangement allows the use of economical apparatus, particularly a less expensive type diode since the resistance of this element does not enter into the system to load the reset operation. Track circuit operation is thus assured with a low voltage alternating current source with poor regulation and assures operation even under poor ballast conditions. The entire arrangement thus results in an efficient and economical apparatus assuring the continuity of operation of a Type C track circuit.

Although I have herein shown and described but a single arrangement embodying the track circuit power transfer apparatus of my invention, it is to be understood that various modifications and changes may be made therein within the scope of the appended claims without departing from the spirit and scope of my invention.

Having now described the invention, what I claim as new and desire to secure by Letters Patent, is:

1. Power transfer apparatus, for assuring continuity of operation of a railroad track circuit including a source of alternating current energy and a direct current track relay connected in multiple across the rails at one end of the corresponding track section, comprising in combination, (a) a diode and a direct current transfer relay connected in a multiple path network, (b) said multiple path network and an energized position contact of said transfer relay connected in series across said rails at the other end of said track section for normally energizing said track relay and said transfer relay through said rails by current from said source rectified by said diode, (c) a battery for supplying an alternate energy source for said track circuit, (d) said battery and a deenergized position contact of said transfer relay also connected in series with said multiple network across said rails at said other end when said alternating current source is inactive, (1) said battery and diode poled to bypass substantially all track current supplied by said battery away from said transfer relay and through said rails to energize said track relay, and (e) a capacitor connected in multiple with said energized position contact of said transfer relay and also in multiple with said deenergized position contact and said battery in series for supplying the initial rectified current pulse from said alternating current source when reactivated to reenergized said transfer relay.

2. Apparatus as defined in claim 1 in which, said diode is also poled that the energy supplied to said track relay from said source and said battery has the same polarity so that said track relay is not forced to release during a power transfer action.

3. A track circuit for an insulated section of railroad track, comprising in combination, (a) a source of alternating current energy connected across the track rails at one end of said section, (b) a direct current track relay connected across said rails at said one end in multiple with said source, (c) a diode, (d) a direct current power transfer relay having an energized and a deenergized position contact, (e) said diode and said transfer relay being connected in a multiple network which is connected in series with said transfer relay energized position contact across said rails at the other end of said section for normally energizing said track and transfer relays with rectified current from said source, (f) a battery for providing at times standby track circuit energy, (1) said battery and said deenergized position contact connected in series with said multiple network across said rails at said other end when said source becomes inactive, (2) said battery and said diode poled to supply energy to said track relay through said rails substantially exclusive of said transfer relay, and (g) a capacitor connected in multiple with the series circuit through said deenergized contact and said battery for providing a low impedance path for reenergizing said transfer relay when said source is restored active.

4. A track circuit as defined in claim 3 in which, said diode and battery are also poled for supplying energy to said track relay of the same polarity as said source so that said track relay is not forced to release during the transfer to the standby energy source.

5. In combination with a railroad track circuit comprising an alternating current source and a direct current track relay connected in parallel across the rails at one end of of the corresponding track section and a diode connected across said rails at the other end of said corresponding section for normally energizing said track relay with alternate half cycles from said source, (a) a direct current power transfer relay connected in parallel with said diode and having a set of front and back contacts closed when that relay is energized and deenergized, respectively, (b) said power transfer relay and diode network being further connected in series with said power transfer front contact across said rails at said other end for normally holding said transfer relay energized by said alternate half cycles from said source and deenergizing said transfer relay when said source becomes inactive, (c) a track battery connected in series with said transfer relay back contact, (d) said battery and back contact series circuit also connected in series with said transfer relay and diode parallel network across said rails for energizing said track relay when said source is inactive, and (e) a capacitor connected in parallel with said front contact and with said back contact and battery series circuit for initially energizing said transfer relay when said source is reactivated or a rail shunt is cleared.

6. The apparatus combination as defined in claim 5 in which, said diode is poled for bypassing current from said track battery away from said transfer relay and for supplying current from said track battery to said rails to energize said track relay with same polarity as from said source, whereby said track relay is not forced to release during substitution of said track battery when said source fails.

* * * * *